US007587918B2

(12) United States Patent
Imgrüt

(10) Patent No.: US 7,587,918 B2
(45) Date of Patent: Sep. 15, 2009

(54) CRIMPING DEVICE

(75) Inventor: Peter Imgrüt, Baar (CH)

(73) Assignee: Komax Holding AG, Dierikon (CH)

( * ) Notice: Subject to any disclaimer, the term of this patent is extended or adjusted under 35 U.S.C. 154(b) by 0 days.

(21) Appl. No.: 11/531,850

(22) Filed: Sep. 14, 2006

(65) Prior Publication Data

US 2007/0062237 A1 Mar. 22, 2007

(30) Foreign Application Priority Data

Sep. 19, 2005 (EP) ..... 05108628

(51) Int. Cl.
*B21C 51/00* (2006.01)
*B21C 1/00* (2006.01)

(52) U.S. Cl. ..... 72/21.4; 72/712

(58) Field of Classification Search ..... 72/20.1, 72/20.2, 21.4, 712, 416
See application file for complete search history.

(56) References Cited

U.S. PATENT DOCUMENTS 5,271,254 A * 12/1993 Gloe et al. ..... 72/13.2
5,937,505 A 8/1999 Strong et al.
6,067,828 A 5/2000 Bucher et al.
6,161,407 A * 12/2000 Meisser ..... 72/21.4
6,212,924 B1 * 4/2001 Meisser ..... 72/21.4
6,418,769 B1 * 7/2002 Schreiner ..... 72/21.4
6,782,608 B2 * 8/2004 Ohsumi et al. ..... 29/753
7,024,752 B2 * 4/2006 Imgrut et al. ..... 29/566.2
2004/0007041 A1 1/2004 Imgrut et al.

FOREIGN PATENT DOCUMENTS

DE 196 22 390 A1 12/1996

* cited by examiner

*Primary Examiner*—Dana Ross
*Assistant Examiner*—Debra M Sullivan
(74) *Attorney, Agent, or Firm*—Fraser Clemens Martin & Miller LLC; William J. Clemens

(57) ABSTRACT

A crimping device has for each crimper an anvil including a conductor anvil provided with a force sensor on which the force that arises in the conductor anvil during the crimping operation acts. The conductor anvil rests on a sensor body which in turn rests on a supporting part of the crimping device. The force sensor measures the force that is required to manufacture the conductor crimp, the quality of the crimped fastening being assessable by reference to the force curve generated by the force sensor.

16 Claims, 4 Drawing Sheets

CRIMPING DEVICE

BACKGROUND OF THE INVENTION

The present invention relates to a crimping device and a method of fastening a crimp contact to a wire, the wire conductor and wire insulation being fastenable to the crimp contact by means of a crimper and anvil, and the crimping force that thereby arises on the anvil being measurable by means of a force sensor.

U.S. Pat. No. 5,937,505 shows a crimping press by which an electrical contact can be fastened onto the end of a wire. A crimping punch and a crimping anvil together fasten the crimp contact to the wire end, the force arising in the crimping anvil being measurable by means of a force sensor.

A disadvantage of such devices is that the entire crimping force (conductor crimping force and insulation crimping force) is measured. It also is disadvantageous that the sensor is built into a wear part.

SUMMARY OF THE INVENTION

It is here that the present invention sets out to provide a remedy. The invention provides a solution for avoiding the disadvantages of the known device, and creating a device and a method that enable precise measurement of the crimping force.

The advantages achieved by means of the invention include that the force required to produce the conductor crimp is measurable. The force in the conductor anvil is transmitted to only one sensor. The pattern of the force during the crimping operation is measured and analyzed, the quality of the crimped connection being assessed by reference to the force curve. The force measurement according to the present invention meets the high requirements for quality assurance.

In the device according to the present invention, provided on each crimper is an anvil, the crimping force arising on a conductor anvil being measurable by means of a force sensor.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
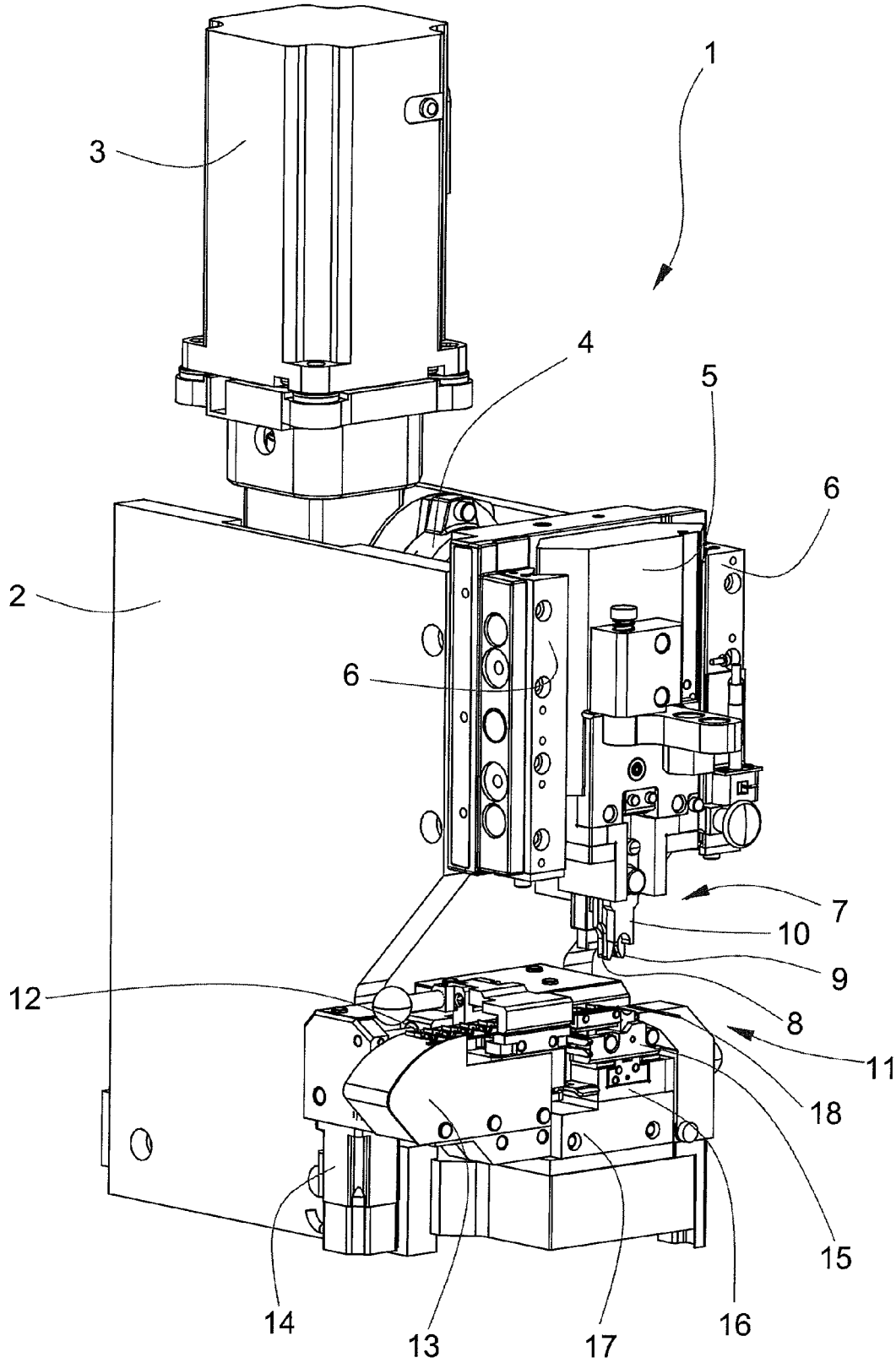
FIG. 1 a perspective view of a crimping press according to the present invention.

FIG. 1 shows a crimping press 1 according to the present invention comprising a first housing 2 on which a press motor 3 that drives a gear 4 is arranged. Provided on the output side of the gear is an eccentric device that converts the rotational motion of the motor 3 and gear 4 into a linear up-and-down motion that can be transferred to a press carriage 5, the press carriage 5 being guided by means of guides 6. Provided for the production of a crimped fastening between a crimp contact 22 (FIG. 2) and wire 18, and arranged on the press carriage 5, is an upper tool 7 with conductor crimper 8, an insulation crimper 9, and a cutter plunger 10, the upper tool 7 working in conjunction with a lower tool 11. The lower tool 11 comprises an anvil part 15, a sensor part 16, and a first supporting part 17. The crimp contacts 22 to be processed are parts of a contact belt 12 that is advanced by a contact advancer 13. An advancing motor 14 drives the contact advancer 13.

Figure 2:
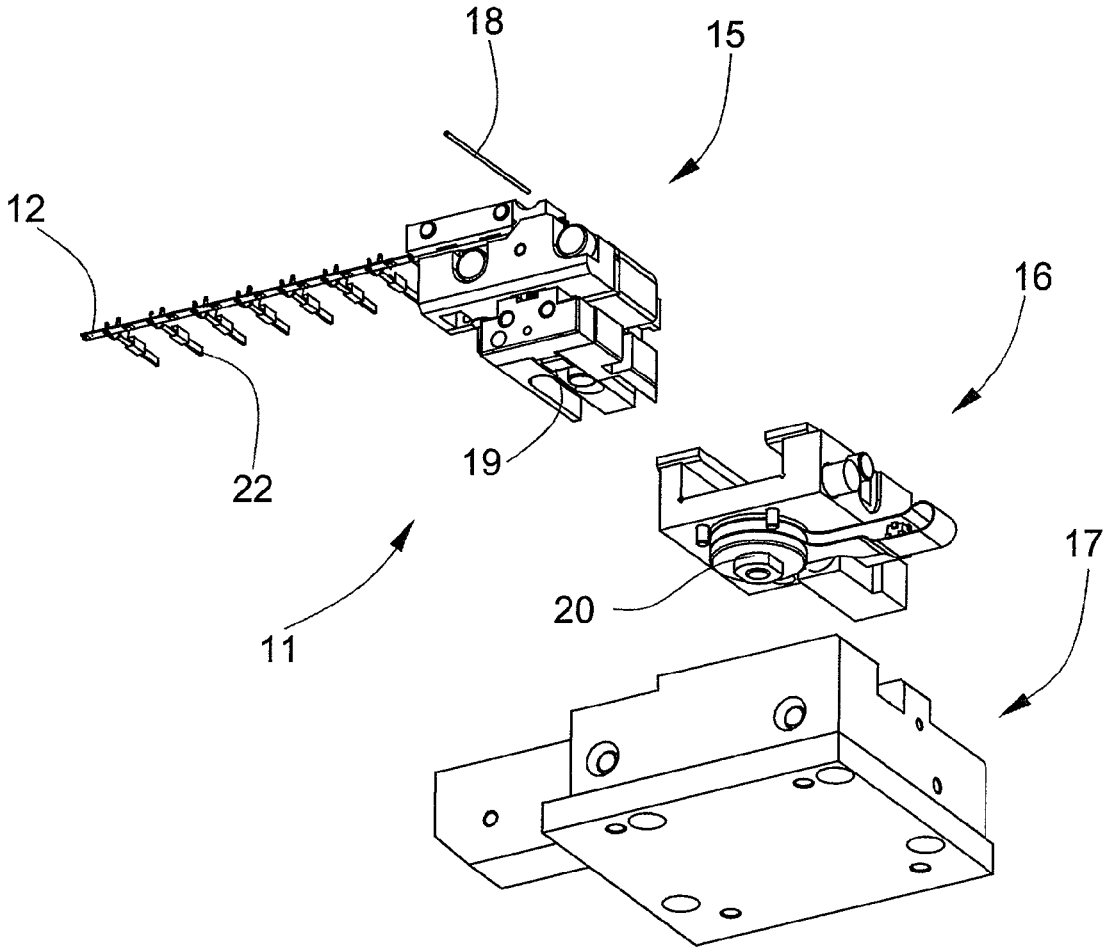
FIG. 2 is an enlarged, exploded perspective view of a lower tool of the crimping press show in FIG. 1.
Figure 3:
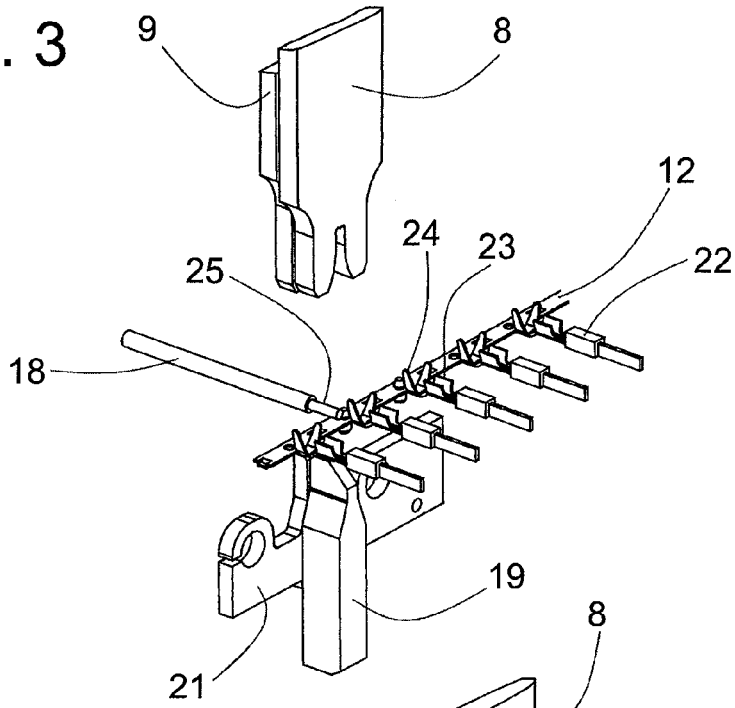
FIG. 3 is enlarged, exploded perspective view of a crimper, an anvil, and a crimp contact before crimping.

FIG. 2 shows the lower tool 11 with the anvil part 15, the sensor part 16, and the first supporting part 17. Arranged on the anvil part 15 is a conductor anvil 19 and an insulation anvil 21 (FIG. 3). Arranged on the sensor part 16 is a force sensor 20 on which the force that arises in the conductor anvil 19 acts, the force sensor 20 in turn being supported on the first supporting part 17. The first supporting part 17 itself is supported on the first housing 2.

FIG. 3 shows the crimper 8, 9, the conductor anvil 19, the insulation anvil 21, and a one of the crimp contacts 22 of the contact belt 12 before the crimping operation. The belted crimp contact 22 rests with its conductor crimp 23 on the conductor anvil 19 and with its insulation crimp 24 on the insulation anvil 21. The wire 18 whose end is stripped of insulation is positioned above the crimp contact 22, a free wire conductor 25 lying above the conductor crimp 23, and a wire insulation 26 lying above the insulation crimp 24. The conductor crimp 23 and insulation crimp 24 respectively are essentially V-shaped and open toward the top. The wire end is positioned in the conductor crimp 23 or insulation crimp 24 respectively by means of the lowering movement of the crimper 8, 9.

Figure 4:
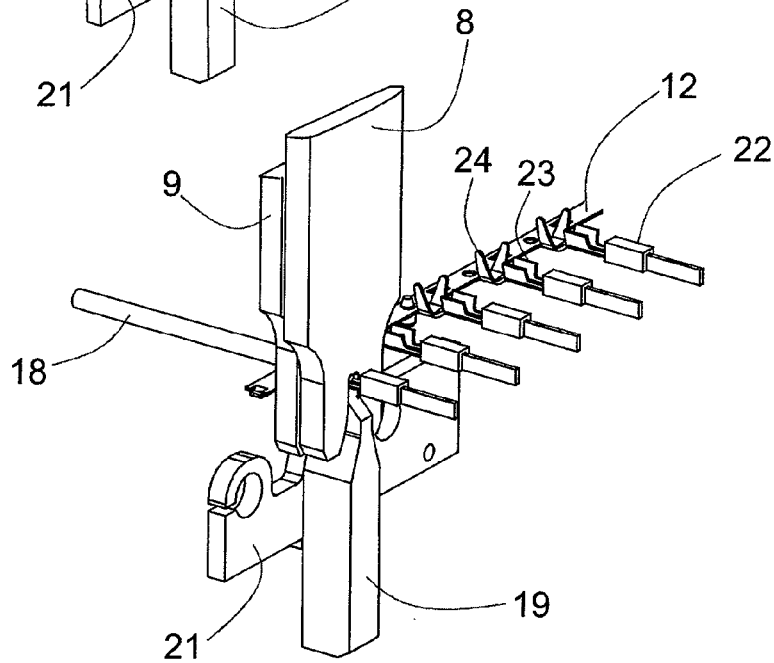
FIG. 4 is enlarged, exploded perspective view of the crimper, the anvil, and the crimp contact during crimping.
Figure 5:
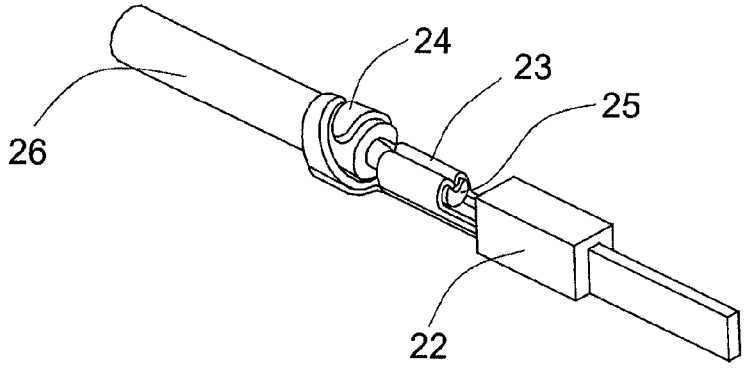
FIG. 5 is enlarged, exploded perspective view of the crimp contact after crimping.

FIG. 4 shows the crimper 8, 9, the conductor anvil 19, and the insulation anvil 21 during crimping of the crimp contact 22 of the contact belt 12, the conductor crimp 23, and the insulation crimp 24 being thereby plastically deformed as shown in FIG. 5. The conductor crimp 23 embraces the strands of the wire conductor 25, and the insulation crimp 24 embraces the wire insulation 26. During the crimping operation, the crimp contact 22 is separated from the contact belt 12.

Figure 6:
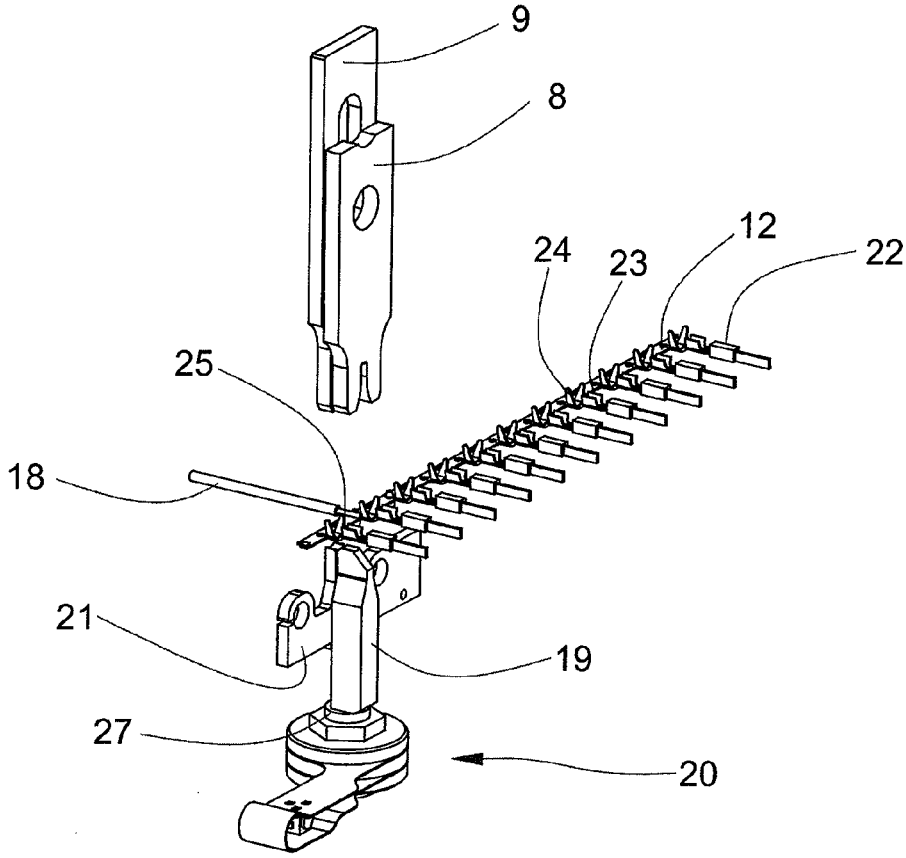
FIG. 6 is enlarged, exploded perspective view of the conductor anvil with a force sensor.

FIG. 6 shows the conductor anvil 19 with the force sensor 20, on which the force that arises in the conductor anvil 19 during the crimping operation acts. The conductor anvil 19 rests on a sensor body 27 which in turn rests on the first supporting part 17. Instead of the one force sensor 20, several force sensors can be provided that measure the force that arises in the conductor anvil 19. For example, wire strain gauges arranged on the conductor anvil 19 can measure the crimping force.

Figure 7:
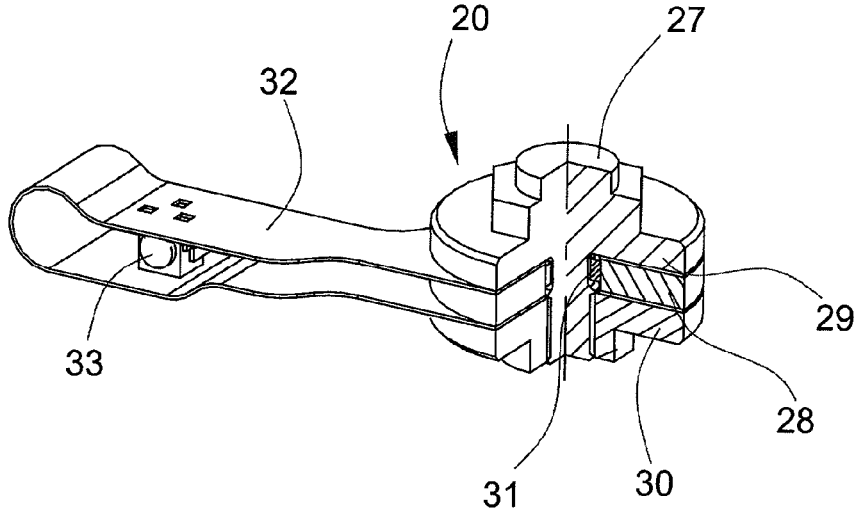
FIG. 7 is enlarged, exploded perspective view of the force sensor of FIG. 6 in partial cross section.

FIG. 7 shows details of the force sensor 20 with the sensor body 27. A disk-shaped piezoelectric element 28 that responds to the force of the conductor anvil 19 is arranged between a first disk 29 and a second disk 30 and electrically insulated from the sensor body 27 by means of a plastic ring 31. The sensor body 27 and the first disk 29 are made of one piece, the second disk 30 being threaded onto the sensor body 27. Conducting pathways integrated in a foil 32 conduct the signal of the piezoelectric element 28 to a plug connector 33.

In a further exemplary embodiment, the sensor body 27 is executed as a threaded screw with screw head, and the first disk 29 is executed as a loose disk with drilled hole. The threaded screw penetrates the drilled hole and the piezoelectric element 28. The second disk 30 is screwed onto the end of the threaded screw with its internal thread and then the two disks 29, 30 are screwed by means of the screw head until the required pretension of the piezoelectric element 28 is attained.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A crimping device for fastening a crimp contact to a wire, the wire having a conductor and a wire insulation being fastenable to the crimp contact by a crimper and an anvil, comprising:

a conductor anvil;

an insulation anvil separate from said conductor anvil;

a conductor crimper cooperating with said conductor anvil to crimp the crimp contact to the conductor in a crimping operation;

an insulation crimper cooperating with said insulation anvil to crimp the crimp contact to the insulation in the crimping operation; and a force sensor for sensing a crimping force that arises on said conductor anvil during the crimping operation wherein said conductor anvil rests on top of said force sensor, said insulation anvil does not rest on top of said force sensor, and said force sensor does not sense any force that arises on said insulation anvil during the crimping operation.

2. The crimping device according to claim 1 wherein said force sensor rests on a first supporting part of the crimping device.

3. The crimping device according to claim 1 wherein said force sensor includes a sensor body supporting a piezoelectric element that responds to the crimping force that arises on said conductor anvil.

4. The crimping device according to claim 3 wherein said piezoelectric element is disk shaped and is arranged between a first disk and a second disk, said first and second disks being arranged on said sensor body.

5. Method of operating a crimping device for fastening a crimp contact to a wire, the wire having a conductor and a wire insulation being fastenable to the crimp contact by a crimper and an anvil, comprising:

a. providing a conductor anvil and an insulation anvil separate from the conductor anvil;

b. providing a conductor crimper cooperating with the conductor anvil to crimp the crimp contact to the conductor in a crimping operation and providing an insulation crimper cooperating with the insulation anvil to crimp the crimp contact to the insulation in the crimping operation;

c. providing a force sensor for sensing a crimping force that arises on the conductor anvil during the crimping operation wherein the conductor anvil rests on top of the force sensor and the insulator anvil does not rest on top of the force sensor;

d. operating the crimpers to perform the crimping operation; and e. sensing the crimping force that arises only on die conductor anvil during die crimping operation using the force sensor.

6. The method according to claim 5 including resting the force sensor on a first supporting part of the crimping device prior to performing said step d.

7. The method according to claim 5 including providing the force sensor with a sensor body supporting a piezoelectric element that responds to the crimping force of the conductor anvil.

8. The method according to claim 7 including forming the piezoelectric element with a disk shape and arranging the piezoelectric element between a first disk and a second disk, the first and second disks being arranged on the sensor body.

9. A crimping device for fastening a crimp contact to a wire, the wire having a conductor and a wire insulation being fastenable to the crimp contact by a crimper and an anvil, comprising:

a conductor anvil;

an insulation anvil separate from said conductor anvil;

a conductor crimper cooperating with said conductor anvil to crimp the crimp contact to the conductor in a crimping operation;

an insulation crimper cooperating with said insulation anvil to crimp the crimp contact to the insulation in the crimping operation; and a force sensor directly contacting said conductor anvil for sensing only a crimping force that arises on said conductor anvil during the crimping operation, wherein the insulator anvil does not contact the force sensor.

10. The crimping device according to claim 9 wherein said force sensor includes a sensor body supporting a piezoelectric element that responds to the crimping force that arises on said conductor anvil.

11. The crimping device according to claim 10 wherein said piezoelectric element is disk shaped and is arranged between a first disk and a second disk, said first and second disks being arranged on said sensor body.

12. The crimping device according to claim 4 wherein the piezoelectric element is electrically insulated from the sensor body by a plastic ring disposed therebetween.

13. The crimping device according to claim 4 wherein the sensor body and the first disk are made of one piece.

14. The crimping device according to claim 4 wherein at least one of the first disk and the second disk is threaded onto the sensor body.

15. The crimping device according to claim 4 further comprising a foil in electrical communication with the piezoelectric element and a plug connector, the foil configured to conduct a signal from the piezoelectric element to the plug connector.

16. The crimping device according to claim 4 wherein the sensor body is a threaded screw with a screw head, the first disk has a first hole, the piezoelectric element has a second hole, and the second disk has a third hole with an internal thread, the threaded screw disposed through the first, second, and third holes and cooperating with the internal thread of the second disk to provide a pretension on the piezoelectric element.

* * * * *